United States Patent [19]

Groothuis et al.

[11] 4,170,822

[45] Oct. 16, 1979

[54] DRY SHAVING APPARATUS

[75] Inventors: Gerrit J. Groothuis; Tjamme de Vries, both of Drachten, Netherlands

[73] Assignee: U.S. Philips Corporation, New York, N.Y.

[21] Appl. No.: 849,037

[22] Filed: Nov. 7, 1977

[30] Foreign Application Priority Data

Dec. 1, 1976 [NL] Netherlands ..... 7613355

[51] Int. Cl.[2] ..... B26B 19/04

[52] U.S. Cl. ..... 30/43.92; 30/346.51

[58] Field of Search ..... 30/43.91, 43.92, 346.51

[56] References Cited

U.S. PATENT DOCUMENTS

| | | | |
|---|---|---|---|
| 3,060,569 | 10/1962 | Oliver | 30/346.51 X |
| 3,468,025 | 9/1969 | Messinger | 30/346.51 |
| 3,815,232 | 6/1974 | Liska | 30/346.51 |

FOREIGN PATENT DOCUMENTS

| | | | |
|---|---|---|---|
| 1553648 | 9/1970 | Fed. Rep. of Germany | 30/346.51 |
| 2309694 | 9/1973 | Fed. Rep. of Germany | 30/346.51 |

*Primary Examiner*—Gary L. Smith

*Attorney, Agent, or Firm*—Thomas A. Briody; William J. Streeter; Rolf E. Schneider

[57] ABSTRACT

A dry-shaving apparatus comprises a shear foil having hair entrance apertures and a cutting member movable relative to the shear foil and including a flexible cutter plate formed with lamellar cutting elements extending between two oppositely disposed edge portions of the cutter plate and separated from each other by slots. A regular pattern of openings formed in each edge portion of the cutter plate is so arranged that an opening is situated at the corresponding base of each lamellar cutting element.

3 Claims, 5 Drawing Figures

DRY SHAVING APPARATUS

This invention relates to a dry shaving apparatus with a shear foil in which hair entrance apertures are formed and a cutting member which is movable relative to the foil, which cutting member comprises a holder and a flexible cutter plate with two oppositely disposed edge portions which are provided with means for fixation to the holder and which cutter plate is provided with lamellar cutting elements which extend from edge portion to edge portion, which elements are separated by slots in the cutter plate.

Such a dry shaving apparatus is for example known from published Netherlands Patent application No. 72 13778. It is generally desired to have the cutter plate as thin as possible so as to minimize the consumption of material and to minimize the weight of the cutting member. The width of the lamellar cutting elements should also be as narrow as possible so as to facilitate the passage of the hairs to be cut through the hair entrance apertures. Conversely, the strength and the rigidity of the cutter plate should meet specific minimum requirements because of the forces acting on it during operation of the apparatus. Moreover, it is of importance that the flexibility of the portion of the cutter plate between the fixation means on both sides is as constant as possible, for optimum adaptation of the cutter plate to the usually arcuated shape of the shear foil.

It is an object of the invention to provide a shaving apparatus of the type described hereinbefore, which meets the said requirements in an optimum manner. The construction in accordance with the invention is characterized in that the edge portions of the cutter plate are provided with a regular pattern of openings.

The openings are preferably situated at the base of each lamella. The mechanical properties of the cutter plate can then be influenced simply but effectively by a construction which is characterized in that a narrow slit-shaped continuation of each slot extends between two adjacent openings.

A special embodiment, which is related thereto and which concerns a shaving apparatus in which the slots are bounded by edges of the lamellar cutting elements which project from the plane of the cutter plate, is characterized in that the narrow slit-shaped continuations of the slots are bounded by corresponding edges which project from the surface of the cutter plate.

The invention will now be described in more detail in connection with the accompanying drawings, in which.

Figure 1:
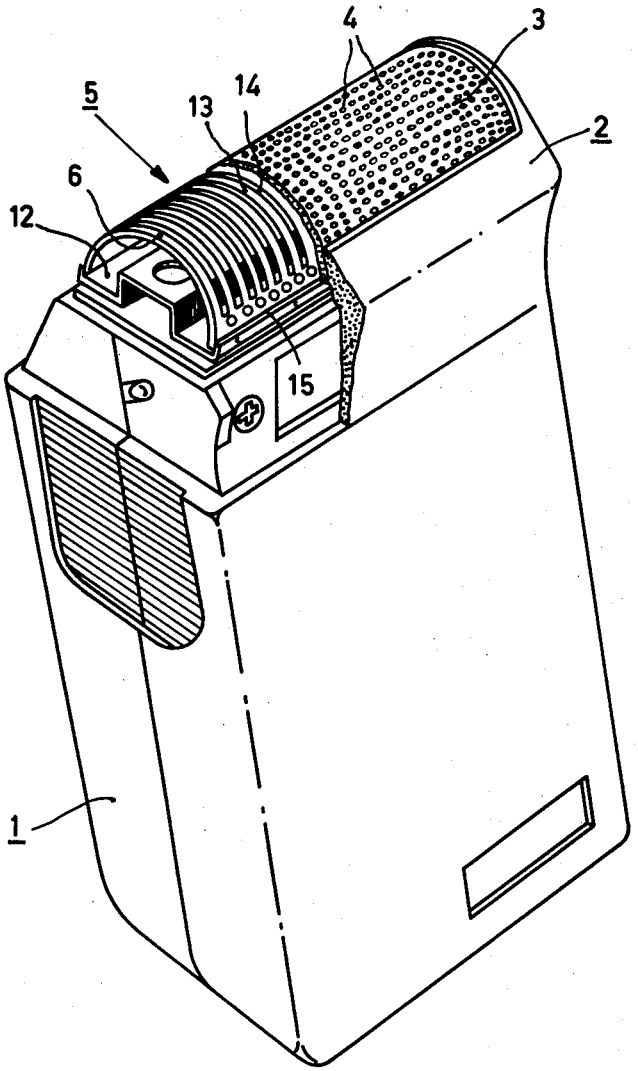
FIG. 1 shows a shaving apparatus with partly cutaway components, so that the cutting member becomes visible.

The dry shaving apparatus shown in FIG. 1 comprises a two-piece plastic housing 1, with a detachable cap 2 at the top in which the shear foil 3 is secured. The foil consists of a thin flexible arcuated plate in which, distributed over the surface, a plurality of hair entrance apertures 4 is formed. Underneath the foil 3 a cutting member 5 is situated. This cutting member comprises a thin arcuated cutter plate 6 and is of substantially rectangular shape in the flat condition (see FIG. 2). The cutter plate has edge portions 9 and 10 which extend along the edges 7 and 8, which edge portions are provided with fixation means 11. Said fixation means may for example take the form of openings 11 with the aid of which the cutter plate can be hooked behind projecting portions of the holder 12 of the cutting member in known manner. The cutter plate 6 comprises lamellar cutting elements 13 which extend from edge portion to edge portion and which are separated by slots 14.

The cutting member 5 is reciprocative parallel to the edges 7 and 8 by an electric motor which is accommodated in the housing 1.

Figure 2:
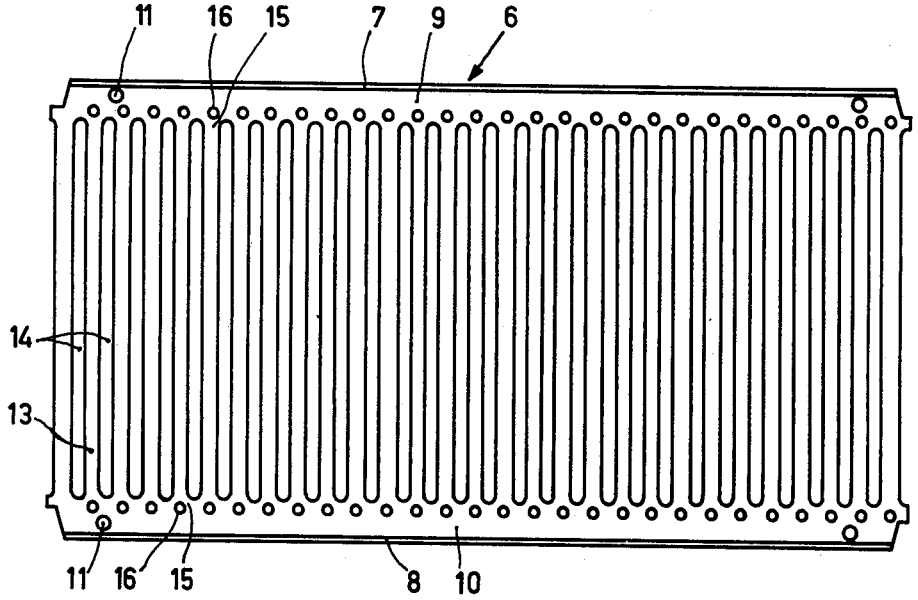
FIG. 2 shows the cutter plate of the cutting member of the apparatus of FIG. 1 in non-arcuated condition.
Figure 3:
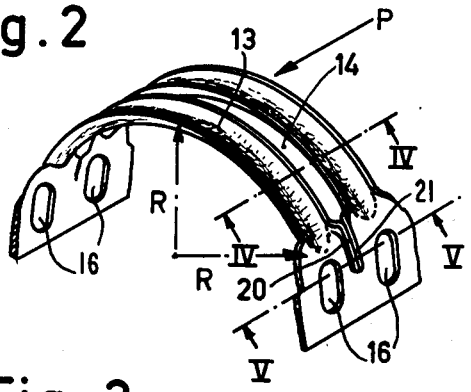
FIG. 3 shows a part of another form of the cutter plate in arcuated condition.
Figure 4:
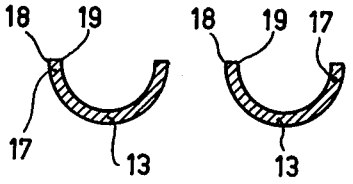
FIG. 4 is a cross-section taken on the line IV—IV in FIG. 3.
Figure 5:
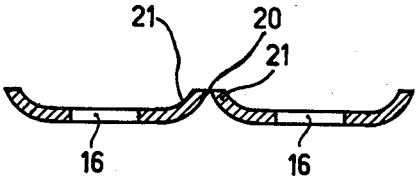
FIG. 5 is a cross-section taken on the line V—V in FIG. 3.

For the shaving action of the apparatus it is of importance that the width of the lamellar cutting elements 13 is minimized. Moreover, the mass of the cutting member 5 should be low. Conversely, the lamellar cutting elements should be sufficiently strong and rigid so as to resist the force designated P in FIG. 3. This force P exerts both a torsional moment and a bending moment on the cutting element. When the cutting element 13 is assumed to be bent in accordance with a semicircle of radius R, the influence of P is a maximum at the location of the base 15 of the cutting element, because at this location the arm of the moments is greatest, namely R. Generally speaking, the length of the lamellar cutting elements 13 should therefore be minimized. However, the edge portions 9 and 10, which are not traversed by the slots 14 have a higher resistance to bending than the central portion of the cutter plate with the lamellae, so that no constant curvature of the cutter plate can be obtained. This problem can be solved by providing the edge portions with a regular pattern of openings 16. In the embodiment of FIGS. 1 and 2 an opening 16 is formed at the base of each cutting element 13. Thus, a cutter plate can be obtained of substantially constant resistance to bending over its entire width, i.e. over the length of the cutting elements and over that part of the edge portions 9 and 10 which does not engage with the holder 12.

The openings 16 may be situated nearer the edges 7 and 8 than the ends of the slots 14, but they may also be situated completely or partly between the slots.

The openings 16 have a special advantage when the plate is manufactured in accordance with an electroforming method, because with such a method the layer thickness is least at the locations with the greatest area. Thus, by means of openings at the bases of the lamellar cutting elements a layer thickness can be obtained at the bases which is approximately the same as near the other parts of the cutting elements.

In the embodiment in accordance with FIGS, 3, 4 and 5 the cutting elements 13 at the convex side of the cutter plate are provided with edges 17 which project from the surface of the cutter plate and whose sides 18 and 19 form the cutting edges. In this embodiment the slots 14 are narrowed to slit-shaped continuations 20 which are also bounded by edges 21 which project from the surface of the cutter plate. In this way the strength and the rigidity of the cutter plate can further be made to meet the minimum requirements.

What is claimed is:

1. A dry-shaving apparatus, which comprises a shear foil having hair entrance apertures, a cutting member movable relative to the shear foil and including a holder and a flexible cutter plate formed with two oppositely disposed edge portions, means provided in each edge portion for fixation of the cutter plate to the holder, lamellar cutting elements extending from edge portion to edge portion of the cutter plate, slots in the cutter plate separating the lamellar cutting elements, and a single row of openings in each edge portion of the cutter plate so arranged that an opening is situated opposite each lamellar cutting element, said row being spaced from the slots.

2. A dry-shaving apparatus according to claim 1, in which a narrow slit-shaped continuation of each slot extends between the adjacent openings.

3. A dry-shaving apparatus according to claim 2, in which the edges of the lamellar cutting elements bounding each slot project above the surface of the cutter plate, and the narrow slit-shaped continuation of each slot is also bounded by corresponding edges projecting above the surface of the cutter plate.

* * * * *